US010284959B2

(12) United States Patent
Xiao et al.

(10) Patent No.: US 10,284,959 B2
(45) **Date of Patent: *May 7, 2019**

(54) LOUDSPEAKER

(71) Applicant: AAC Technologies Pte, Ltd., Singapore (SG)

(72) Inventors: Bo Xiao, Shenzhen (CN); Ronglin Linghu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/816,664

(22) Filed: Nov. 17, 2017

(65) Prior Publication Data

US 2018/0367919 A1 Dec. 20, 2018

(30) Foreign Application Priority Data

Jun. 20, 2017 (CN) ..... 2017 2 0723590 U

(51) Int. Cl.

| | |
|---|---|
| ***H04R 1/00*** | (2006.01) |
| ***H04R 9/06*** | (2006.01) |
| ***H04R 9/02*** | (2006.01) |
| ***H04R 7/12*** | (2006.01) |
| ***H04R 7/18*** | (2006.01) |

(52) U.S. Cl.

CPC ..... *H04R 9/06* (2013.01); *H04R 7/12* (2013.01); *H04R 7/18* (2013.01); *H04R 9/025* (2013.01); *H04R 2400/11* (2013.01)

(58) Field of Classification Search

CPC . H04R 9/04; H04R 7/127; H04R 9/06; H04R 2400/11; H04R 1/06; H04R 7/02

See application file for complete search history.

(56) References Cited

U.S. PATENT DOCUMENTS

| | | | | |
|---|---|---|---|---|
| 10,003,887 | B2 * | 6/2018 | Linghu | H04R 9/045 |
| 2014/0056464 | A1 * | 2/2014 | Li | H04R 9/025 381/400 |

* cited by examiner

*Primary Examiner* — Amir H Etesam

(74) *Attorney, Agent, or Firm* — Na Xu; IPro, PLLC

(57) ABSTRACT

A loudspeaker includes a frame; a vibration system having a membrane, a voice coil for driving the membrane to vibrate, and an elastic support piece opposite to the membrane for elastically supporting the voice coil; a magnetic circuit system. The elastic support piece includes a diaphragm and a flexible circuit board fixedly connected to the diaphragm. The diaphragm includes a first connecting part, a second connecting part and a first folding ring part connecting the first connecting part and the second connecting part. The membrane includes a second folding ring part corresponding to the first folding ring part. The first folding ring part is a convex structure bulging toward the membrane, the second folding ring part is a concave structure sinking toward the diaphragm; the diaphragm and the voice coil transmit electrical signals with the external circuits through the flexible circuit board.

9 Claims, 3 Drawing Sheets

LOUDSPEAKER

FIELD OF THE PRESENT DISCLOSURE

The present disclosure relates to electro-acoustic transducers, more particularly to a loudspeaker.

DESCRIPTION OF RELATED ART

With the rapid development of mobile communication technology in recent years, consumers are using communication equipment with voice functions more and more, such as portable phones, handheld game consoles, portable computers, laptop computers, multimedia players and other devices that can communicate through public or private communication networks. A traditional loudspeaker structure comprises a frame, a vibration system and a magnetic circuit system accommodated in the frame, the vibration system comprises a membrane, a voice coil and an elastic support piece. However, the existing products with this structure are poor in stability, and are prone to produce swings under the influence of external forces.

Therefore it is necessary to provide an improved loudspeaker for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

Figure 1:
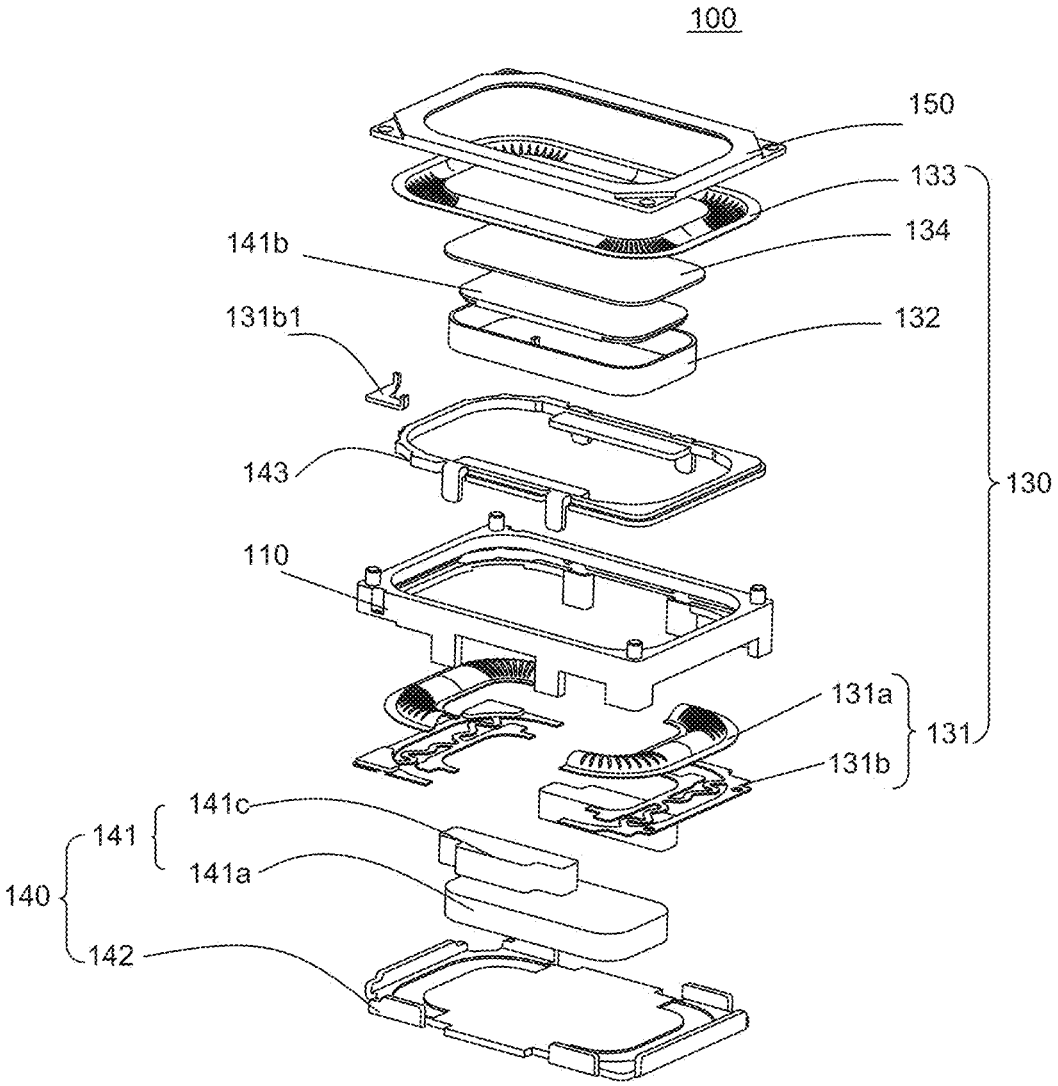
FIG. 1 is an isometric view of a loudspeaker in accordance with an exemplary embodiment of the present disclosure.
Figure 2:
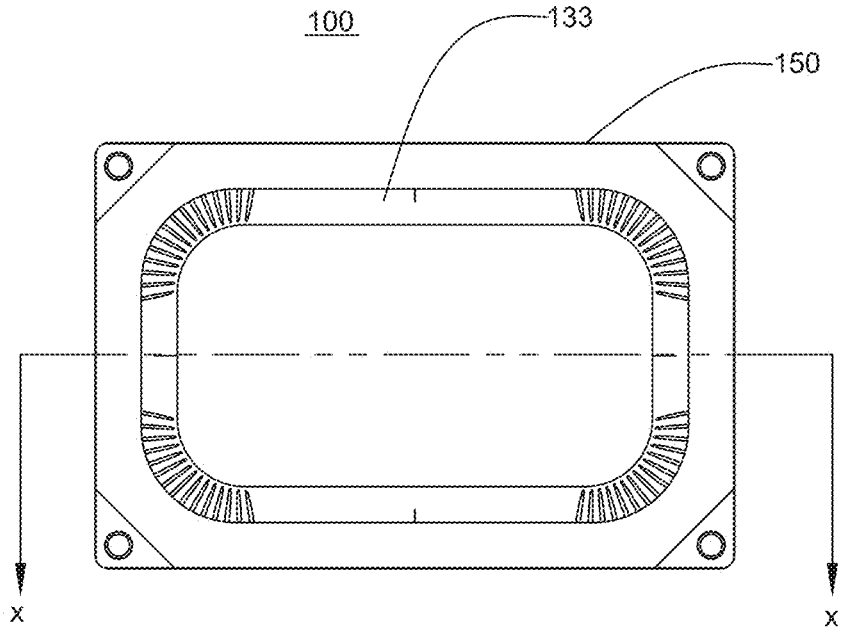
FIG. 2 is a front view of the loudspeaker in FIG. 1.
Figure 3:
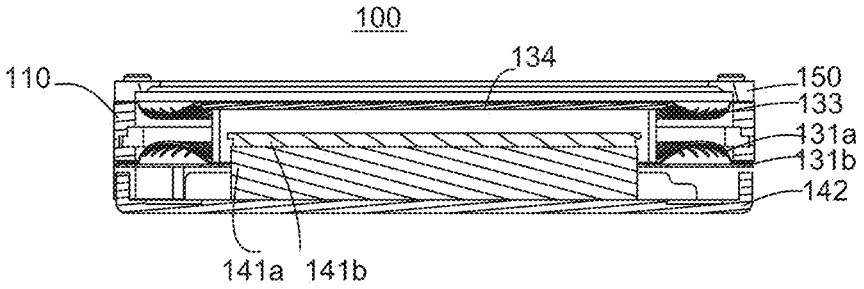
FIG. 3 is a cross-sectional view of the loudspeaker, taken along line x-x in FIG. 2.
Figure 4:
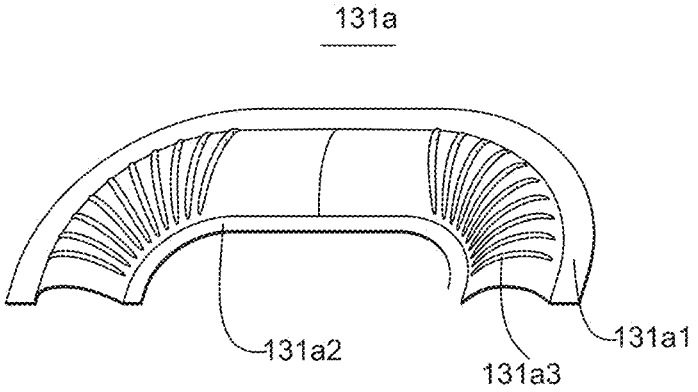
FIG. 4 is an illustration of a diaphragm of the loudspeaker in FIG. 1.
Figure 5:
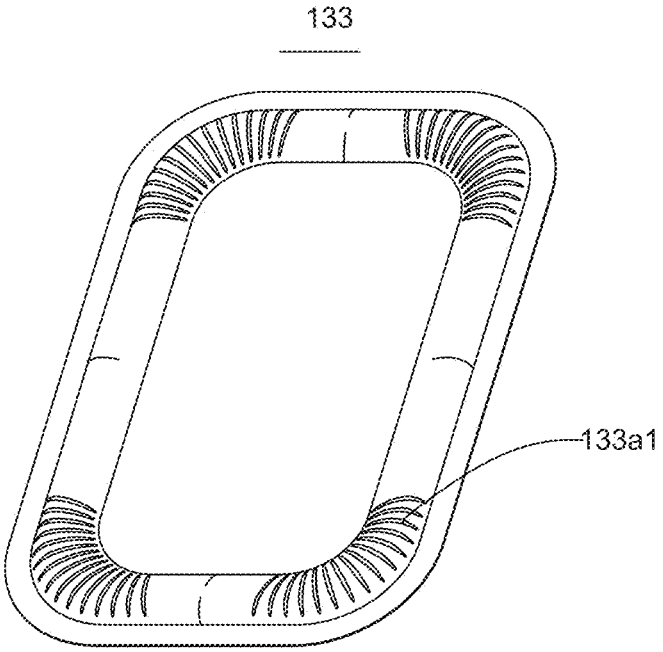
FIG. 5 is an illustration of a membrane of the diaphragm.

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

As shown in FIG. 1, FIG. 2, FIG. 3, FIG. 4 and FIG. 5, as one aspect of the disclosure, a loudspeaker 100 is provided. The loudspeaker 100 comprises a frame 110, a vibration system 130 and a magnetic circuit system 140 fixed at the frame 110. The vibration system 130 comprises a membrane 133, a voice coil 132 which is located beneath the membrane 133 and drives the membrane 133 to vibrate and produce sounds and an elastic support piece 131 which is located beneath the voice coil 132 and elastically supports the voice coil 132. The elastic support piece 131 can be fixed at the bottom part of the voice coil 132 far from the membrane 133 or fixed at the middle part of the voice coil

132. The elastic support piece 131 comprises a diaphragm 131*a* and a flexible circuit board 131*b* fixedly connected at the lower part of the diaphragm 131*a*, the diaphragm 131*a* comprises a first connecting part 131*a*1 fixedly connected at the frame 110, a second connecting part 131*a*2 fixedly connected at the voice coil 132 and a first folding ring part 131*a*3 connecting the first connecting part 131*a*1 and the second connecting part 131*a*2, the membrane 133 comprises a second folding ring part 133*a*1 corresponding with the first folding ring part 131*a*3, the first folding ring part 131*a*3 is a convex structure bulging toward the membrane 133, the second folding ring part 133*a*1 is a concave structure sinking toward the direction of the diaphragm 131*a*. The diaphragm 131*a* and the voice coil 132 transmit electrical signals with the external circuits through the flexible circuit board 131*b*.

For the loudspeaker 100 with the structure of this embodiment, the first folding ring part 131*a*3 of the diaphragm 131*a* is a convex structure bulging toward the membrane 133, the second folding ring part 133*a*1 of the membrane 133 is a concave structure sinking toward the direction of the diaphragm 131*a*. A loudspeaker with this structure has a more stable structure, and is not prone to produce swings under the influence of external forces, therefore its performance is more stable.

As shown in FIG. 1, the vibration system 130 described above also comprises a ball top 134 beneath the membrane 133, the magnetic circuit system 140 comprises a magnet 141 and a lower plate 142 on which the magnet 141 is placed, the lower plate 142 is provided at the lower end of the frame 110, wherein the lower plate 142 and the frame 110 form together an accommodation space accommodating the vibration system 130 and the magnetic circuit system 140.

The loudspeaker 100 with the structure of this embodiment uses a space formed together by the lower plate 142 and the frame 110 fixedly connected to the lower plate 142 to accommodate the magnetic circuit system 140 and the vibration system 130. It has the advantages of simple structure, easy processing, and convenient maintenance.

Wherein, as shown by FIG. 1, at the lower plate 142, a concave part (no marking) can also be provided below the elastic support piece 131, which can accommodate the magnetic circuit system 140 and the vibration system 130 described above better.

Referring to FIG. 1. further, the magnet 141 comprises a main magnet 141*a* installed at the middle part of the lower plate 142, a pole plate 141*b* is provided at the part of the main magnet 141*a* far from the lower plate 142, a magnetic gap is formed between the main magnet 141*a*, the pole plate 141*b* and the frame 110, and the voice coil 132 is inserted in the magnetic gap.

As shown in FIG. 1, the magnet 141 also comprises a secondary magnet 141*c* symmetrically provided at the two sides opposite the main magnet 141*a* and provided with a interval relative to the main magnet 141*a*, the voice coil 132 is provided between the main magnet 141*a* and the secondary magnet 141*c*.

As shown in FIG. 1, the magnetic circuit system 140 also comprises an upper plate 143 provided at the side of the secondary magnet 141*c* far from the lower plate 142, the secondary magnet 141*c* is clamped between the upper plate 143 and the lower plate 142, the upper plate 143 is fixed at the frame 110.

To make the loudspeaker 100 with this structure more compact, the upper plate 143 is provided as wound around the periphery of the pole plate 141*b* and is level with the pole plate 141*b*.

As shown in FIG. 1, the diaphragm 131*a* is symmetrically provided at the two other sides of the main magnet 141*a*, and the diaphragm 131*a* and the secondary magnet 141*c* are both provided as enclosing the periphery of the main magnet 141*a*.

As shown in FIG. 1, a conducting terminator 131*b*1 electrically connected with the voice coil 132 is provided at the side of the flexible circuit board 131*b* relative to the membrane 133.

In addition, the loudspeaker 100 with this structure also comprises a top cover 150 provided as a cover over the membrane 133, which will encapsulate the vibration system 130 and the magnetic circuit system 140 in an accommodation space formed by the frame 110 and the lower plate 142.

For the loudspeaker 100 with the structure of this embodiment, its stacked structure is adjusted to a structure of concave membrane 133+voice coil 131*a*+convex diaphragm 132+flexible circuit board 131*b*, this structure can effectively restrain the swing of the loudspeaker 100 in low frequency, effectively increase the maximum low frequency output sound pressure of a micro loudspeaker, improve the low frequency tone quality, and at the same time improve the fall resistance and performance stability of the finished products.

In the second aspect, the disclosure provides an electronic device, which includes a loudspeaker, and the loudspeaker comprises a loudspeaker 100 described above.

The electronic device of the disclosure includes the loudspeaker 100 with the structure described above, and the stacked structure of the loudspeaker 100 is adjusted to a structure of concave membrane 133+voice coil 132+positive folding ring diaphragm 131*a*+flexible circuit board 131*b*, this structure can effectively restrain the swing of the loudspeaker 100 in low frequency, effectively increase the maximum low frequency output sound pressure of a micro loudspeaker, improve the low frequency tone quality, at the same time improve the fall resistance and performance stability of the finished products, and increase the service life of the electronic devices.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A loudspeaker, including a frame;

a vibration system having a membrane, a voice coil located below the membrane for driving the membrane to vibrate, and an elastic support piece opposite to the membrane for elastically supporting the voice coil;

a magnetic circuit system fixed at the frame;

the elastic support piece including a diaphragm and a flexible circuit board fixedly connected at a lower part of the diaphragm;

the diaphragm comprising a first connecting part fixedly connected at the frame, a second connecting part fixedly connected at the voice coil and a first folding ring part connecting the first connecting part and the second connecting part;

the membrane including a second folding ring part corresponding to the first folding ring part; wherein the first folding ring part is a convex structure bulging toward the membrane, the second folding ring part is a concave structure sinking toward the diaphragm; the diaphragm and the voice coil transmit electrical signals with the external circuits through the flexible circuit board.

2. The loudspeaker as described in claim 1, wherein the magnetic circuit system comprises a magnet and a lower plate carrying the magnet, the lower plate is provided on a lower end of the frame for cooperatively forming an accommodation space.

3. The loudspeaker as described in claim 2, wherein the lower plate has a concave part provided below the elastic support piece.

4. The loudspeaker as described in claim 2, wherein the magnet comprises a main magnet installed at a middle part of the lower plate, a pole plate provided at the part of the main magnet far from the lower plate, and a magnetic gap formed between the main magnet, the pole plate and the frame.

5. The loudspeaker as described in claim 4, wherein the magnet further comprises a secondary magnet symmetrically provided at the two sides opposite the main magnet and keeping a distance from the main magnet, and the voice coil is at least partially located between the main magnet and the secondary magnet.

6. The loudspeaker as described in claim 5, wherein the magnetic circuit system comprises an upper plate provided at the side of the secondary magnet far from the lower plate, the secondary magnet is clamped between the upper plate and the lower plate, and the upper plate is fixed at the frame.

7. The loudspeaker as described in claim 6, wherein the upper plate surrounds a periphery of the pole plate and is coplanar with the pole plate.

8. The loudspeaker as described in claim 5, wherein the diaphragm is symmetrically provided at the two other sides of the main magnet, and the diaphragm and the secondary magnet are both arranged enclosing the periphery of the main magnet.

9. The loudspeaker as described in claim 1 further including a conducting terminator electrically connected with the voice coil provided at a side of the flexible circuit board relative to the membrane.

* * * * *